US005894935A

United States Patent [19]

Stein

[11] Patent Number: 5,894,935

[45] Date of Patent: Apr. 20, 1999

[54] METHOD AND DEVICE TO SEPARATE A FINE-GRAINED SOLID MATERIAL INTO TWO FRACTIONS

[75] Inventor: Juergen Stein, Stadtbergen, Germany

[73] Assignee: Hosokawa Alpine Aktiengesellschaft, Augsburg, Germany

[21] Appl. No.: 08/286,037

[22] Filed: Aug. 4, 1994

[30] Foreign Application Priority Data

Aug. 7, 1993 [DE] Germany ..... 43 26 605

[51] Int. Cl.[6] ..... B03D 3/00

[52] U.S. Cl. ..... 209/210; 209/725; 210/512.3

[58] Field of Search ..... 209/155, 208, 209/210, 725; 210/512.1, 512.3

[56] References Cited

U.S. PATENT DOCUMENTS

| | | | |
|---|---|---|---|
| 2,255,807 | 9/1941 | Plumlee | 209/210 |
| 2,996,187 | 8/1961 | Pryne | 209/210 |
| 3,089,959 | 5/1963 | Kaiser | 250/207 |
| 3,152,078 | 10/1964 | Lavanchy | 209/210 X |
| 4,528,091 | 7/1985 | Nied et al. | 209/139.2 |
| 4,710,284 | 12/1987 | Amit | 209/210 X |
| 4,729,837 | 3/1988 | Henricson | 210/512.3 X |
| 4,863,605 | 9/1989 | Rienecker | 210/512.3 |
| 5,284,250 | 2/1994 | Stepenhoff | 209/210 |

FOREIGN PATENT DOCUMENTS

| | | | |
|---|---|---|---|
| A-0 115 057 | 12/1983 | European Pat. Off. . | |
| A-0 355 285 | 6/1989 | European Pat. Off. . | |
| A-42 14 771 | 11/1993 | European Pat. Off. . | |
| 3-151067 | 6/1991 | Japan . | |
| 1005929 | 3/1983 | U.S.S.R. | 209/725 |
| 1646610 | 5/1991 | U.S.S.R. | 210/512.3 |
| A-1 036 543 | 2/1965 | United Kingdom . | |

*Primary Examiner*—Tuan N. Nguyen
*Attorney, Agent, or Firm*—Pennie & Emonds

[57] ABSTRACT

Method and device for separating a fine-grained solid material into a fines fraction and a coarse fraction at a cut point size of below 50 μm, preferably below approx. 10 μm. The fine-grained solid is dispersed in a liquid capable of forming drops and this dispersion is forced into a defined sink flow with a superimposed rotational flow that is generated independently from the jink flow. The relationship between the two rates, namely the sink flow rate and the rotational flow rate, is dictated by the cut point size. The device includes a deflector wheel which has a direction of flow from the outside to the inside, and vanes are fitted in the wheel parallel to its rotational axis to form flow channels, whereby the feed dispersion is charged to the deflector wheel at its outer periphery.

13 Claims, 6 Drawing Sheets

METHOD AND DEVICE TO SEPARATE A FINE-GRAINED SOLID MATERIAL INTO TWO FRACTIONS

FIELD OF THE INVENTION

The invention is based on the separation into a fines and a coarse fraction of a finely-grained solid dispersed in a liquid. It concerns a method and device to execute this separation in the particle size range below approx. 50 μm, preferably below approx. 10 μm.

BACKGROUND OF THE INVENTION

The preferred devices employed for separating a fine-grained solid with a particle size distribution ranging between 0 and max. 50 μm into a fines fraction and a coarse fraction at a cut point of below about 10 μm are hydrocyclones, in which the separation is achieved through the combined actions of centrifugal force, wall friction, and the drag force of a liquid exercised on the solid particles. Technical reasons related to the flow conditions in a hydrocyclone, however, make a sharp separation in the case of a defined particle size impossible, so that the overlap range, i.e. the particle size range which is present in both the fines fraction and the coarse fraction, is usually undesirably high.

SUMMARY OF THE INVENTION

The objective of the invention, therefore, was to develop a method and a device to separate a fine-grained solid into a fines fraction and a coarse fraction which permits a sharp separation especially in the particle size range below approx. 10 μm to be carried out rationally and economically. The solution to this problem is to disperse the line-grained solid in a liquid capable of forming drops and to force this dispersion into a defined sink (draw-down) flow with a superimposed rotational flow that is generated independently from the sink flow. The relationship between the two independently adjustable rates, namely the sink flow rate and the rotational flow rate, is dictated by the cut point size or rather the point at which the feed dispersion separates into the fines fraction and the coarse fraction, i.e. the particle size at which the centrifugal force generated by the rotational flow and the drag force of the liquid generated by the sink flow are in equilibrium, so that the chances are equal that the particle will enter the fines fraction or the coarse fraction.

The invention method can be realized especially easily by generating the sink and rotational flows in a rotationally driven deflector wheel with the direction of flow from the outside to the inside, that has vanes fitted parallel to its rotational axis which form flow channels, whereby the dispersion is charged to the deflector wheel at is outer periphery.

The device suitable for implementing the invention method consists primarily of a pressure-proof housing which has connections for feeding the original dispersion and for discharging the fine and coarse dispersions, and which contains at least one pivoted and driven deflector wheel, plus a feed pump for charging the feed dispersion to the device.

DETAILED DESCRIPTION OF THE DRAWINGS

Figure 1:
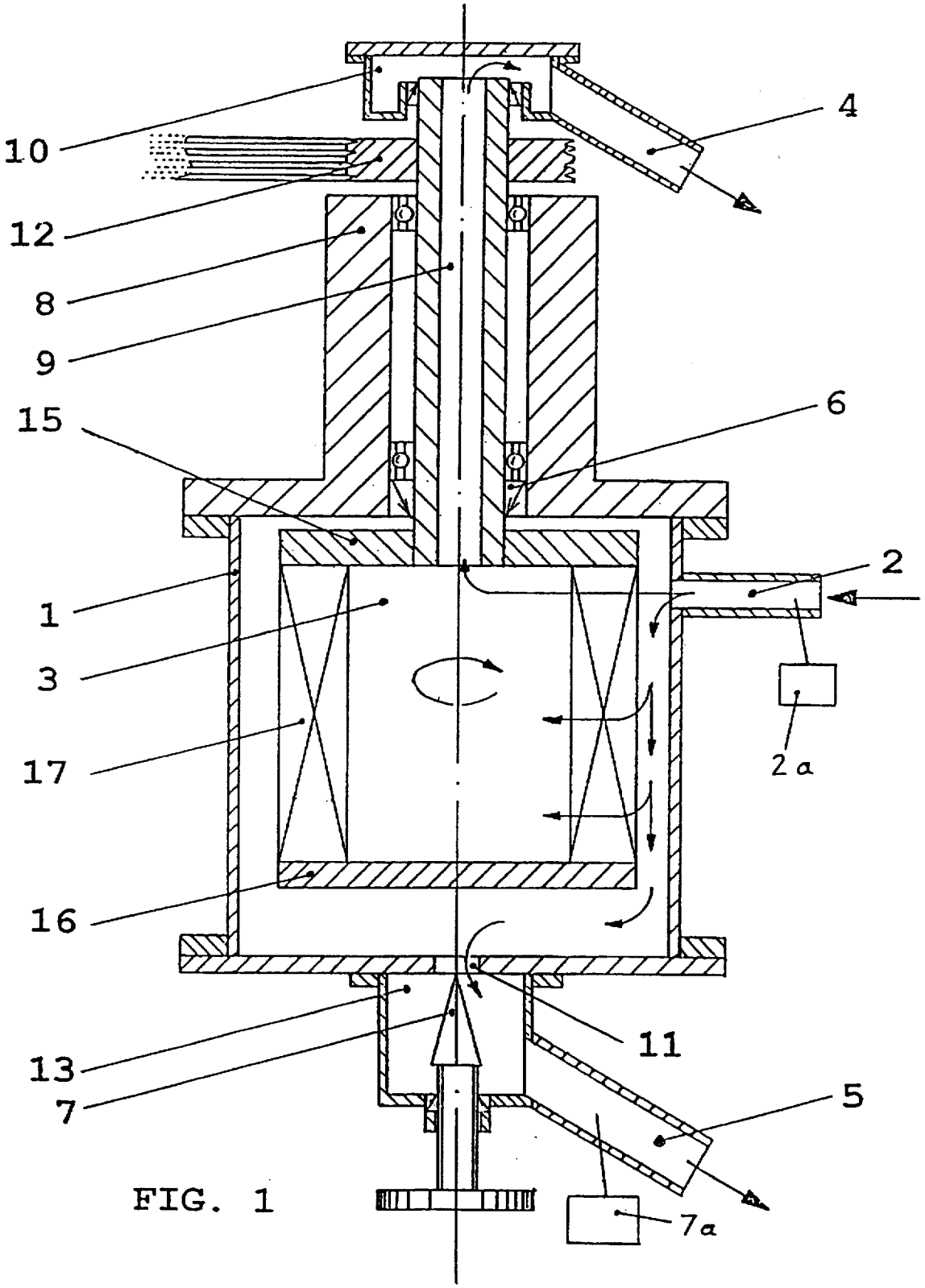
FIG. 1 is a schematic cross-sectional view of a preferred embodiment of the invention.

The deflector wheel is installed in an enclosed housing into which the solid to be classified—dispersed in a liquid and thus called the feed dispersion—is conveyed by means of a feed pump via an inlet connection. The dispersion flows through the rotating deflector wheel from the outside to the inside, during which the separation of the solid into a fine fraction and a coarse fraction takes place. Those particles where the drag force exercised by the flowing liquid is smaller than the centrifugal force exercised by the rotation of the deflector wheel will not be able to reach the center of the wheel and are rejected. Those particles where the drag force is greater than the centrifugal force are conveyed to the center of the wheel by the liquid. This part of the suspension thus contains the fine fraction and exits the housing of the separating device through a discharge port connected to the center zone of the deflector wheel. The rejected particles exit the housing through a second discharge port along with the remainder of the liquid as the coarse dispersion.

Because the deflector wheel rotates, the fine dispersion has to counteract the centrifugal force and overcome a relatively high pressure to flow through the wheel. This pressure, which ranges between 3 and 20bar dependent on the operating conditions, is generated by the feed pump. Because of the pressure load, the housing of the separating device and the bearing unit of the deflector wheel drive shaft must be in pressure-proof design; for the latter, use of a sliding ring seal is generally necessary.

The operating parameters which determine the cut point size are the peripheral speed of the deflector wheel and the radial flow rate within the flow channels formed by the vanes. The peripheral speed can, at a given outside diameter of the deflector wheel, be adjusted alone by the speed of the deflector wheel; the radial flow rate results from the free flow cross-section of the deflector wheel and the volume flow of the fine dispersion. This parameter, together with the volume flow of the coarse dispersion, is determined by the feed rate of the feed dispersion, which is set by adjusting the delivery rate of the feed pump. Because it is customary that the fine dispersion be able to discharge freely, its volume flow is adjusted indirectly by means of the feed rate and the separation ratio of the fine to the coarse dispersion volume flows. This separation ratio is altered by changing the volume flow of the coarse dispersion, e.g. by altering the outlet diameter or by pumping off the coarse dispersion in measured quantities.

In the simplest case, the rotational axis of the deflector wheel is synonymous with the axis of an axially symmetrical, e.g., cylindrical, housing in which the liquid containing the dispersed solid can rotate uniformly along with the deflector wheel without the necessity of any special technical measures. If, especially in the case of a cylindrical vessel, the radial distance between the inside wall of the vessel and the periphery of the deflector wheel is kept small, the result is a uniform flow pattern through the deflector wheel along its entire length. Short-cut flows and reverse flow effects can be effectively prevented in this way. Optimum flow conditions are achieved if the radial distance between the inside wall and the wheel periphery is less than 10% of the deflector wheel diameter.

In difficult cases or when several deflector wheels are installed in one housing, if extremely fine separations and high throughput rates are demanded, it can be advantageous to equip the deflector wheels with special accessories, e.g. with rotating ring discs which effect a uniform pre-acceleration of the liquid and solid as early as the outer zone of the deflector wheels.

The inlet port for the feed dispersion can be fitted to the housing above, below, or close to the deflector wheel, whereby a tangential intake with the direction of flow the same as that of the deflector wheel rotation assists the pre-acceleration of liquid and solid. An additional pre-classifying effect can be achieved by installing the inlet port for the feed dispersion with axial flow direction at the lower end of the housing and central to it. This arrangement causes coarse particles to migrate to the housing wall, so that instead of burdening the deflector wheel, they are discharged immediately. A longer flow path, e.g. through a conical housing element whose diameter is greater at the entry point into the housing than at the connection point, can improve the pre-classifying effect even more.

The deflector wheel can be in standard design, i.e. as a cylindrical wheel with vanes and open space at the center. The potential vortex which forms in this center space, however, generates such a high pressure drop that this type of deflector wheel design is only appropriate for low-speed operation, i.e. for relatively coarse separations at low throughput rates.

Formation of a potential vortex can be prevented with a deflector wheel whose radially aligned vanes extend from the periphery right into the rotational axis arca of the deflector wheel. The separation process now takes place in the so-called solid-bed vortex, whose highest peripheral speed is, in contrast to the potential vortex, at the outer edges of the vanes. The pressure drop is considerably lower, and while being independent of the volume flow, is exclusively dependent on the speed of the deflector wheel. Surprisingly, it was established that finer separations with higher fines yields at simultaneously higher throughput rates could be achieved with a deflector wheel with a solid-bed vortex than with a deflector wheel with a potential vortex.

If a deflector wheel is to effect an optimal separation, the liquid and solid particles must be pre-accelerated as completely as possible before catering the vane channels of the deflector wheel, this applies especially to the use of a deflector wheel with solid-bed vortex. Generally speaking, a suitable arrangement of the connection for the feed dispersion usually achieves a sufficient degree of pre-acceleration. Where this is not the case, it can be helpful to employ ring discs, for example, which are rigidly attached to the deflector wheel and which extend radially from the peripheral zone of the deflector wheel to the outside and are arranged with an axial distance to each other and coaxially to the rotational axis of the deflector wheel. Because of their drag effect, these ring discs effect a uniform and complete pre-acceleration up to the moment of entry in the vane channels.

Besides the pre-acceleration, a uniform flow pattern through the deflector wheel is decisive for an optimum separation effect. Especially in the case of a deflector wheel with solid-bed vortex, it is possible to improve the flow pattern by arranging axialy symmetrical shaped parts coaxially with the rotational axis of the deflector wheel, whereby the radially aligned vanes of the deflector wheel extend from its periphery to the shaped part. The shaped part can be cylindrical, conical, or in the form of a truncated cone.

When classifying a solid dispersed in a liquid there is generally no danger that the solid will deposit on the surfaces with which the dispersion comes into contact. It is therefore possible to make the drive shaft hollow for the fines discharge if the deflector wheel is overhung-mounted, or if the bearings are mounted on both sides of the deflector wheel, only one wheel shaft needs to be hollow. No elaborate sealing of the fines discharge to the inside of the housing is then necessary. The discharging fine dispersion is intercepted in a collector and can then flow off freely. An advantageous design results if the above-mentioned shaped part is designed as part of the hollow drive shaft or axle and has at least one opening for each of the flow channels formed by the deflector wheel vanes through which the liquid and fines can enter the hollow shaft or axle.

FIG. 1 is a schematic representation of an invention-design device with cylindrical housing 1, to which the bearing 8 for the deflector wheel 3 is directly flanged. The vertical-axis deflector wheel 3 is driven via a belt pulley 12 and hollow shaft 9, whose bearings are scaled against the inside of the housing 1 by means of a shaft seal 6. The feed material to be separated, dispersed in a liquid, is pumped by a feed pump **2*a* through connection 2 into the housing 1 from where it enters the deflector wheel 3. The fines separated by the deflector wheel 3 are discharged together with part of the liquid as the fine dispersion through the hollow shaft 9 into the fixed fines collector 10, and flow through connection 4 for further processing. The coarse material rejected by the deflector wheel 3 flows with the remainder of the liquid through the center opening 11 at the bottom of the housing connection 5. The amount of discharging coarse dispersion can be controlled by changing the cross-section of the opening 11; the axially adjustable slide valve 7** serves this purpose.

Figure 2:
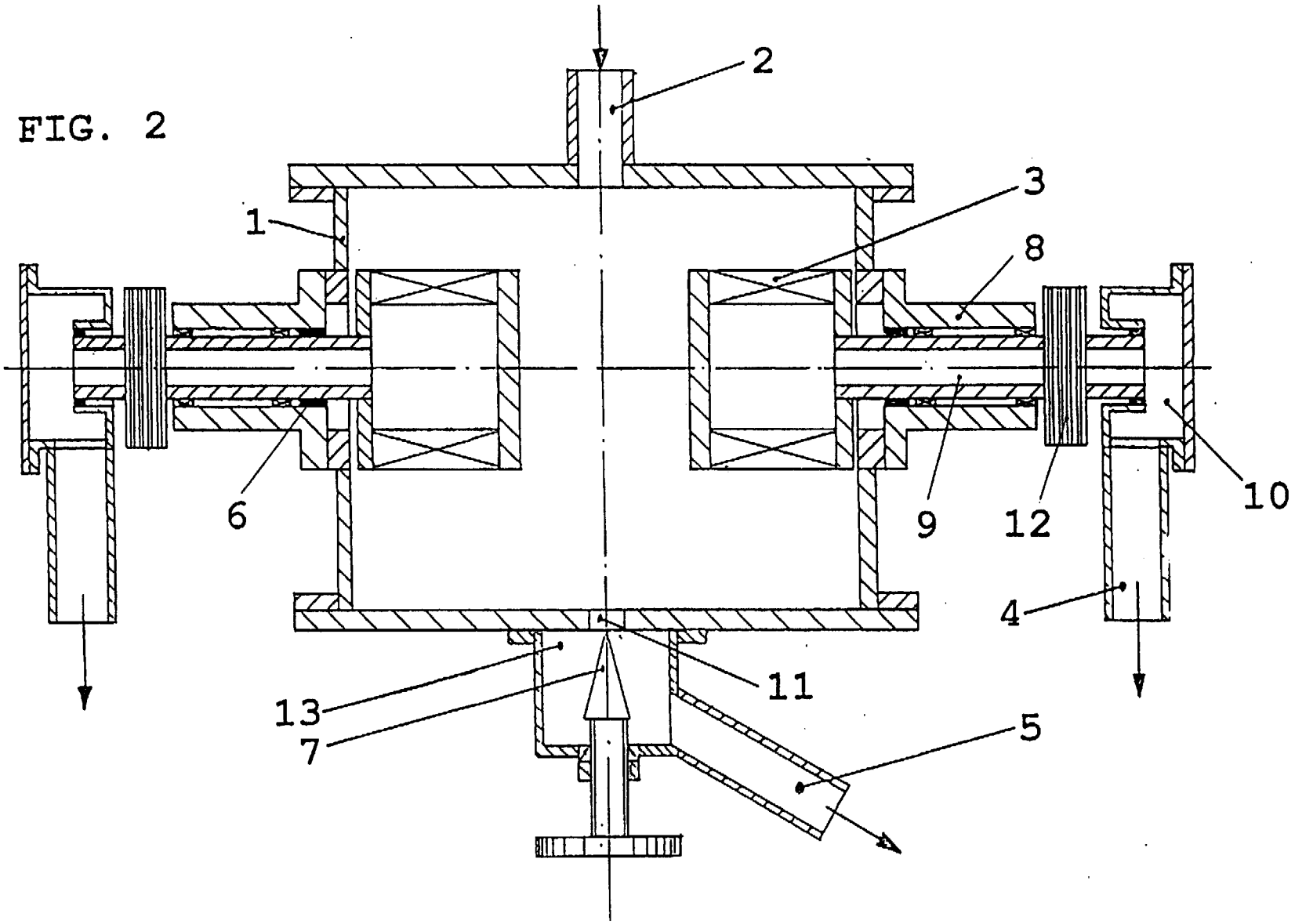
FIG. 2 is a cross-sectional schematic view of an alternative embodiment of the invention.

FIG. 2 shows a variant with several deflector wheels 3 arranged horizontally in a common housing 1. Each deflector wheel 3 is driven by its own motor (not illustrated) via a belt pulley 12. This makes it possible to adjust the speed of each deflector wheel 3 individually, so that a number of fine dispersions of different composition can be simultaneously extracted from one feed dispersion. This variant is the preferred one to achieve high throughputs at a cut point which is set at the same low value for each deflector wheel.

Figure 3:
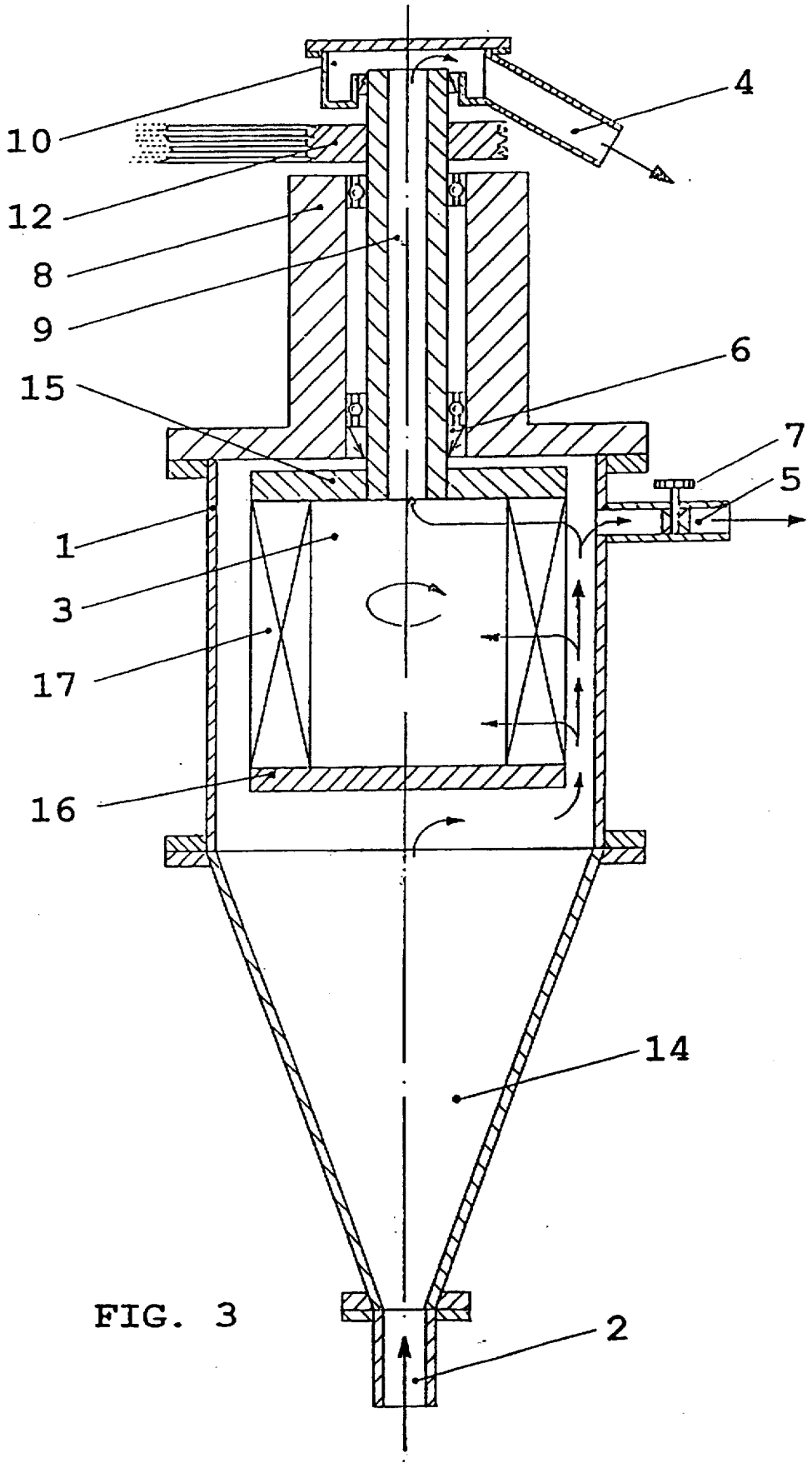
FIG. 3 is a cross-sectional prospective view of another embodiment of the invention.

Instead of the housing 1 having a flat bottom (FIG. 1), FIG. 3 shows that a funnel-shaped component 14 is attached to it, with the inlet connection 2 for the feed dispersion leading into its lowermost point. In comparison to FIG. 1, the connections 2 and 5 are transposed. This design serves to achieve a pre-classification of the feed material in the following way: the rotating deflector wheel 3 causes the introduced dispersion to rotate, which in its turn causes the coarse particles, before they even enter the deflector wheel 3, to be conveyed to the chamber walls of component 14 and housing 1 and braked there, so that they can no longer enter the deflector wheel 3 but instead are discharged direct through connection 5. The slide valve 7 installed at connection 5 serves to control the amount of discharging coarse dispersion. Also, an extraction pump **7*a* with an adjustable conveying rate can be located in the connection 5** for the coarse fraction.

Figure 4:
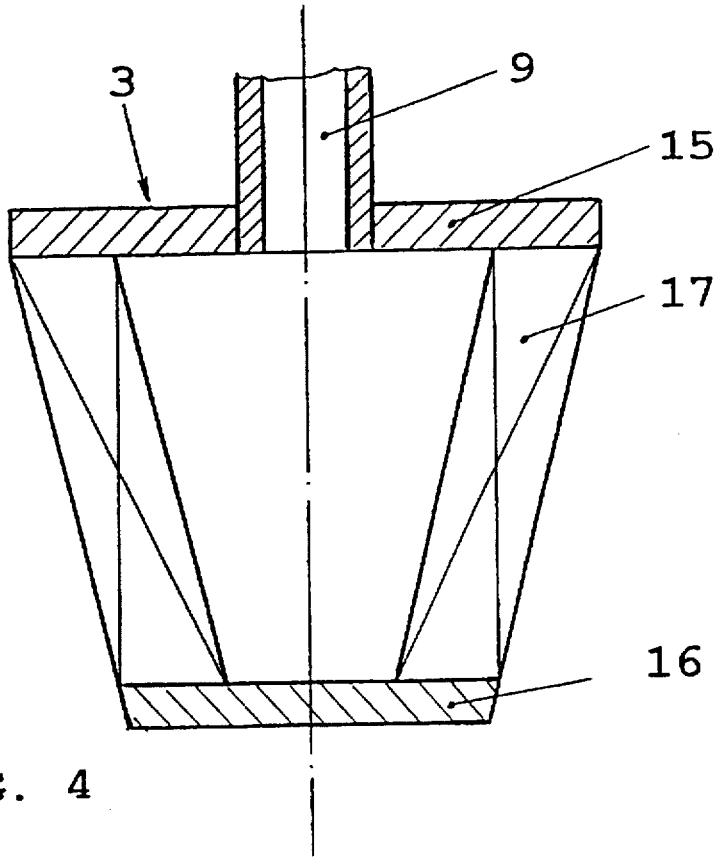
FIG. 4 is a cross-sectional schematic view of a deflector wheel structure for the present invention.

The deflector wheels 3 in FIGS. 1 to 3 consist primarily of two limiting discs 15, 16, connected together at an axial distance from each other, between which vanes 17 that are mounted parallel to the rotational axis and that form flow channels are arranged uniformly around the periphery of the discs, whereby they can be aligned either vertically or at angles to the periphery. The fine dispersion is discharged through a central boring in the limiting disc 15 into the hollow shaft 9. The peripheral surface dictated by the outer edges of the vanes 17 is a cylindrical surface. It can also be designed as in FIG. 4 as a conical surface, with the greatest diameter at the limiting disc 15 with the central boring, to facilitate a more uniform flow pattern through the deflector wheel 3, above all in the free inside space.

Figure 5:
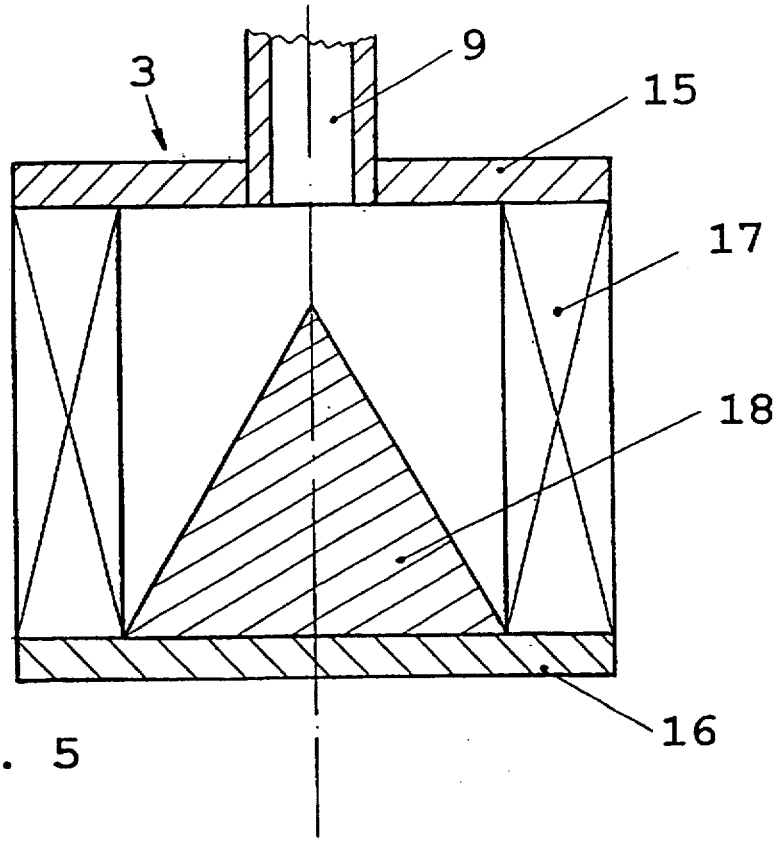
FIG. 5 is cross-sectional schematic view of an alternative embodiment of the deflector wheel.

In FIG. 5, the same task is fulfilled by the conical shaped part 18, mounted concentrically in the deflector wheel 3 and fixed to the limiting disc 16.

Figure 6:
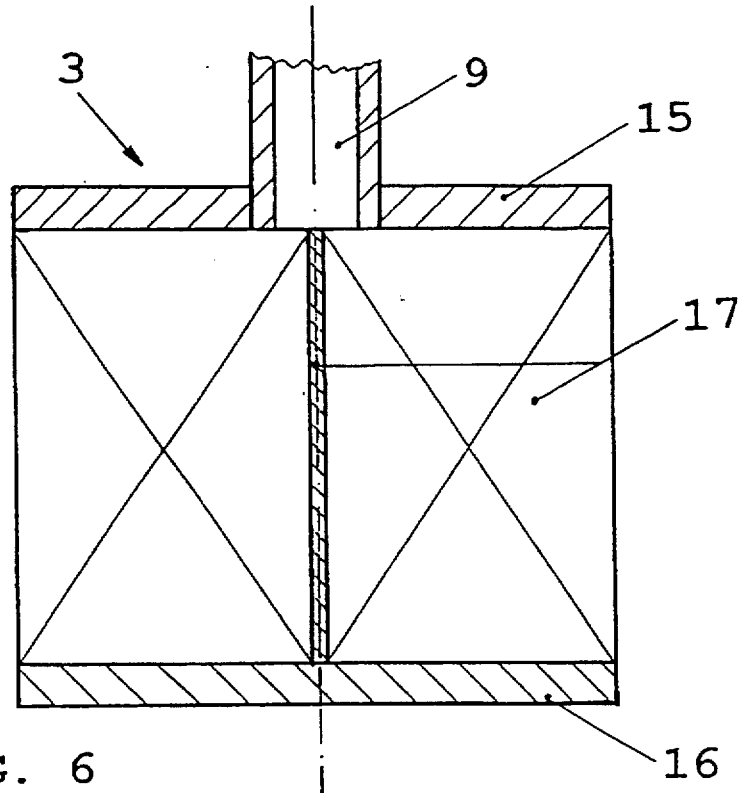
FIG. 6 is a cross-sectional schematic view of another embodiment of the deflector wheel.
Figure 7:
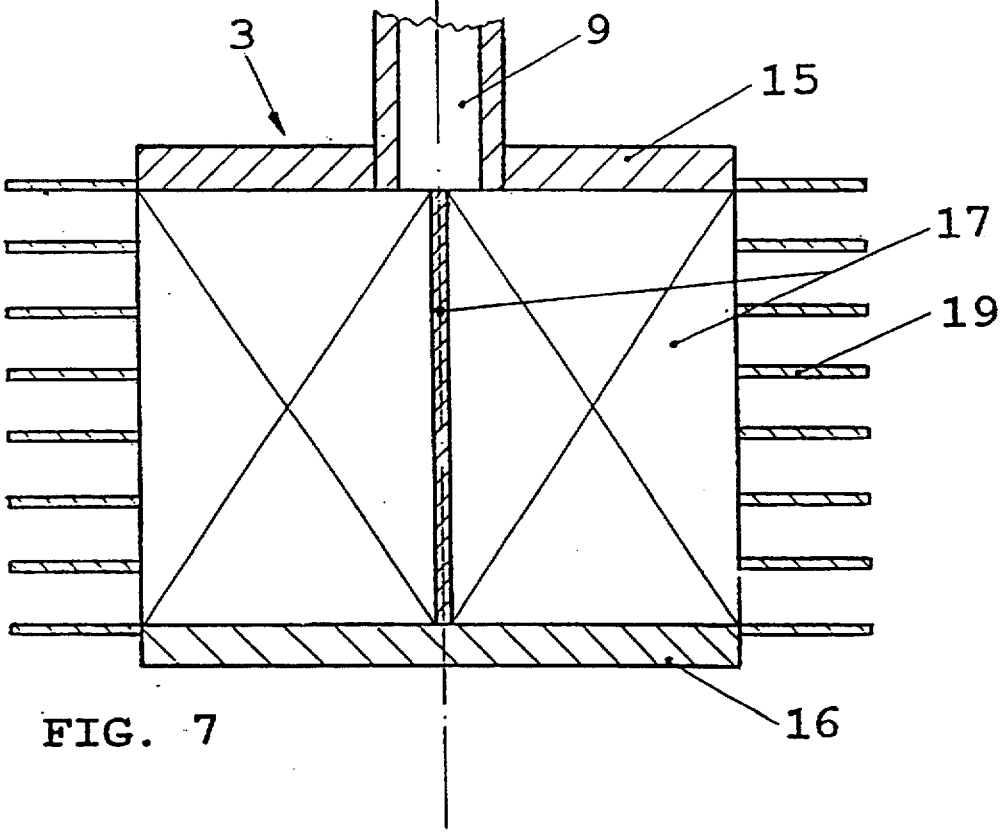
FIG. 7 is a cross-sectional prospective view of another embodiment of the deflector wheel.

The deflector wheels 3 shown in FIGS. 6 and 7 again have a cylindrical peripheral surface, whereby the radially aligned vanes 17 extend to the rotational axis of the deflector wheel 3. With this design, a solid-bed vortex instead of a potential vortex forms in the deflector wheel 3, flat ring discs 19 are attached equidistantly to the deflector wheel 3 in FIG. 7 which extend radially from the periphery of the deflector wheel 3 to the outside and which serve to preaccelerate the feed dispersion being charged to the deflector wheel 3 from the outside.

Figure 8:
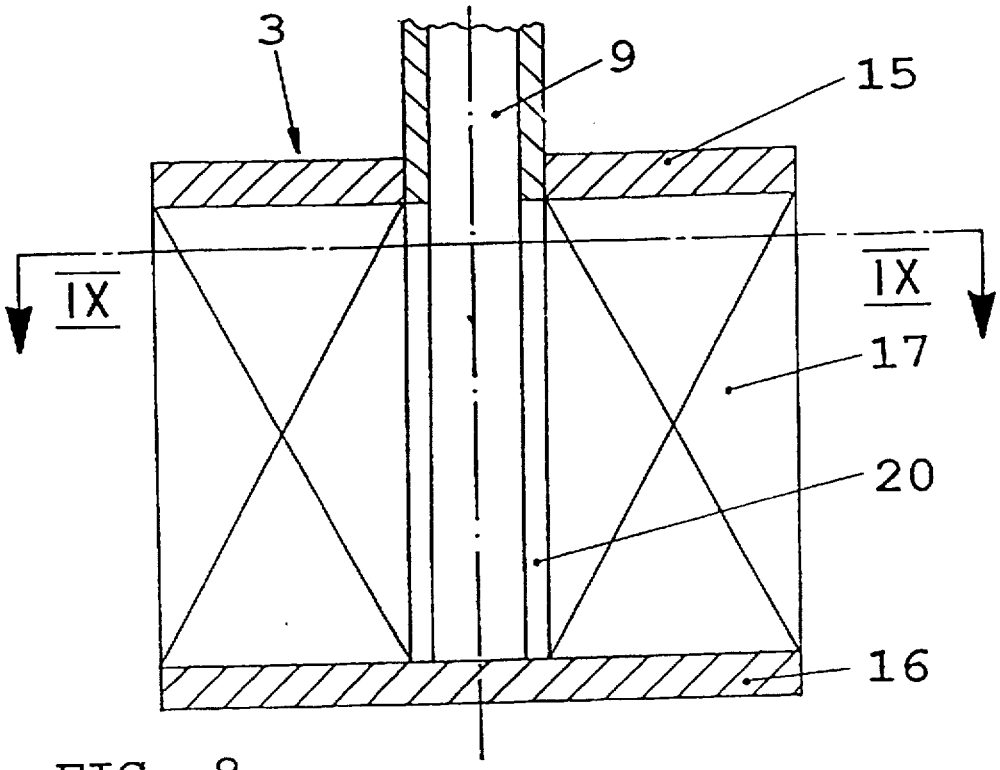
FIG. 8 is a cross-sectional schematic view of still another embodiment of the deflector wheel.
Figure 9:
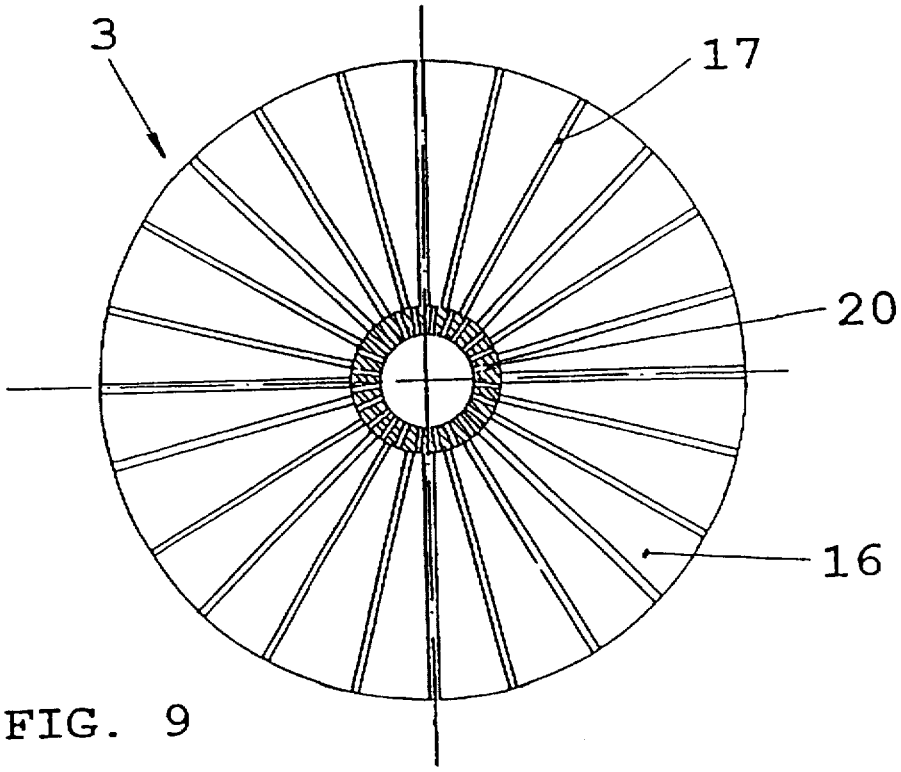
FIG. 9 is a cross-sectional view taken along lines IX—IX of FIG. 8.

FIGS. 8 and 9 show a longitudinal-section and cross-section of a deflector wheel 3 with a shaped part in the form of a cylinder designed to be coaxial with the hollow shaft 9. For each flow channel formed by two neighboring vanes 17, there is a gap 20 in the shaped part which runs lengthwise to the axial extent of the vanes 17 through which the fine dispersion can enter the hollow shaft 9, from where it leaves the separating device via the fines collector 10 and the connection 4 (FIGS. 1 to 3).

I claim:

1. Device for separating a finely-grained solid into a fines fraction and a coarse fraction in which the fine-grained solid is dispersed in a liquid medium to form a dispersion, comprising:

a) a pressure-proof housing (1) having:

1) a first connection (2) for charging the dispersion into said housing, 2) a second connection (4) for discharging said fines fraction from said housing, and 3) a third connection (5) for discharging said coarse fraction from said housing;

b) at least one deflector wheel (3) rotatably mounted within said housing, said deflector wheel (3) having a rotational axis defining the center of the wheel and a plurality of spaced vanes extending radially inwardly from a location defining the periphery of the wheel toward said center, said vanes defining flow channels between adjacent pairs of vanes which extend from said periphery of the wheel to said center thereof;

c) a feed pump for charging said dispersion through said first connection (2) and forcing said dispersion along said flow channels from said periphery of the wheel to said center thereof to generate a sink flow; and d) means (12) for rotating said wheel to generate a rotational flow of said dispersion.

2. Device in accordance with claim 1, wherein said housing is as an axially symmetrical vessel.

3. Device in accordance with claim 1 wherein said housing is a cylindrical housing with an inside wall radially spaced from the periphery of the deflector wheel by less than 10% of the diameter of the deflector wheel.

4. Device in accordance with claim 2, wherein said third connection for the coarse fraction is located at the bottom of the housing in a central position.

5. Device in accordance with claim 2, wherein said first connection for charging said dispersion is located at the bottom of the housing in a central position.

6. Device in accordance with claim 1, said third connection for the coarse fraction includes an outlet diameter which is adjustable in size.

7. Device in accordance with claim 1, wherein an extraction pump having an adjustable conveying rate is located at said third connection for the coarse fraction.

8. Device in accordance with claim 1, wherein said vanes of said deflector wheel are aligned radially and extend from said periphery of the wheel to the area of said rotational axis of the deflector wheel.

9. Device in accordance with claim 1, wherein said vanes of said deflector wheel are radially aligned and extend from said periphery of the wheel to an axially symmetrical shaped part arranged coaxially to said deflector wheel.

10. Device in accordance with claim 9, wherein said shaped part is part of a hollow drive shaft of the deflector wheel, which contains at least one opening for the flow channels formed between said adjacent pairs of vanes to enable the fines fraction to discharge through said second connection (4).

11. Method for separating a finely-grained solid into a fines fraction and a coarse fraction comprising the steps of:

a) dispersing the fine-grained solid in a liquid medium to form a dispersion of said fines fraction and coarse fraction;

b) forcing the dispersion along a first path, extending from a first point to a second point to generate a sink flow, and at a flow rate to create a drag force sufficient to convey at least part of said finely-grained solid of a size distribution toward said second point;

simultaneously and independently forcing said dispersion along a second path to generate a rotational flow and to thereby apply a centrifugal force to the dispersion flowing along the first path of said sink flow between said first and second points, said centrifugal force being applied in opposition to said drage force; and c) controlling at least one of the drag force and centrifugal force to control the size range of said finely-grained solid, and thereby the size range of the fines fraction, conveyed along said path of said sink flow to said second point.

12. Method in accordance with claim 11, further comprising the step of:

a) setting a cut point size between the fines and coarse fractions of the fine-grained solid by selecting a relationship between the sink flow rate and the rotational flow rate.

13. Method in accordance with claim 11, wherein:

a) to generate the sink flow, the dispersion is pumped through a deflector wheel having a rotational axis defining the center of the wheel and a plurality of spaced vanes extending radially inwardly from a location defining the periphery of the wheel toward said center, said pumping of said dispersion being along flow channels located between said vanes and extending from said periphery of the wheel to said center thereof; and b) to generate the rotational flow, said deflector wheel is rotated.

* * * * *